US007356878B2

(12) United States Patent
Foster

(10) Patent No.: US 7,356,878 B2
(45) Date of Patent: Apr. 15, 2008

(54) DOOR CLOSER

(75) Inventor: Keith Foster, London (GB)

(73) Assignee: Samuel Heath & Sons PLC, Birmingham (GB)

( * ) Notice: Subject to any disclaimer, the term of this patent is extended or adjusted under 35 U.S.C. 154(b) by 342 days.

(21) Appl. No.: 11/137,681

(22) Filed: May 25, 2005

(65) Prior Publication Data

US 2005/0273975 A1 Dec. 15, 2005

(30) Foreign Application Priority Data

Jun. 12, 2005 (GB) ..... 0413132.2

(51) Int. Cl.
*E05F 1/00* (2006.01)

(52) U.S. Cl. ..... 16/71; 16/51; 16/54; 16/56; 16/59; 16/61; 16/68; 16/72

(58) Field of Classification Search ..... 16/71, 16/72, 51, 59, 68, 76, 86 C, 85, 61, 54, 56, 16/50

See application file for complete search history.

(56) References Cited

U.S. PATENT DOCUMENTS

| | | | | |
|---|---|---|---|---|
| 1,239,510 | A * | 9/1917 | Nordquist | 16/51 |
| 3,887,961 | A * | 6/1975 | Saajos | 16/56 |
| 4,097,956 | A * | 7/1978 | Kitutaka | 16/52 |
| 4,317,254 | A * | 3/1982 | Chaddock | 16/61 |
| 4,660,250 | A * | 4/1987 | Tillman et al. | 16/58 |
| 5,016,317 | A | 5/1991 | Hung | |
| 5,170,530 | A * | 12/1992 | Kopec et al. | 16/52 |
| 5,706,551 | A | 1/1998 | Jeynes et al. | |
| 6,625,847 | B1 * | 9/2003 | Jones | 16/51 |
| 6,886,217 | B2 * | 5/2005 | Foster | 16/69 |

FOREIGN PATENT DOCUMENTS

| | | |
|---|---|---|
| EP | 469697 A1 * | 2/1992 |
| EP | EP 730076 A1 * | 9/1996 |
| GB | 1497220 | 1/1978 |
| GB | 2167121 | 5/1986 |
| WO | WO 00/52291 | 8/2000 |
| WO | WO 02/063125 | 8/2002 |

* cited by examiner

*Primary Examiner*—Chuck Y. Mah
(74) *Attorney, Agent, or Firm*—Egbert Law Offices

(57) ABSTRACT

A door closer includes an anchor assembly for mounting on a door frame, an actuator assembly for mounting within the thickness of a door which is hinged for movement between open and closed positions, an operating member coupled by a linkage to the anchor assembly and mounted for a range of movements between a retracted position and an extended position, a resilient driving apparatus arranged to exert a driving force on the operating member, a damper mechanism operatively connected to the operating member so as to damp movement of the operating member at least in a direction towards the retracted position, and a resilient thrust device arranged to exert an increased driving force on the operating member over a defined part of its range of movement as the operating member approaches the retracted position.

13 Claims, 4 Drawing Sheets

DOOR CLOSER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention relates to a door closer and more particularly to a door closer of the kind including an actuator assembly intended for concealed fitting within the thickness of a door, and an anchor member for fixing to a door frame, and in which an operating member is coupled to the anchor member and is movable within the actuator assembly under the action of a driving apparatus, usually including one or more mechanical springs, and under the control of a damper mechanism, such as a fluid-filled damper (usually unidirectionally operative), which serves to regulate the rate of movement of the door in the direction of closure without significantly restricting the rate of movement of the door in the direction of opening.

BACKGROUND OF THE INVENTION

A door closer is disclosed in previous European patent application number EP-A-59503 in which during a final part of the closure movement of the door, increased thrust is applied to the door to overcome the force of, for example, a sprung door latch. In that proposal a thrust mechanism including an arrangement of balls and detents is described.

An improved mechanism for achieving the application of increased thrust during the final part of the closure movement of the door is described in later International patent application number WO-A-02/063125. In this proposal, a cam mechanism including a slot and cam follower is provided to apply the increased thrust. The present invention represents an improvement over two former proposals.

BRIEF SUMMARY OF THE INVENTION

According to a first aspect of the invention, a door closer is provided including an anchor assembly for mounting on a door frame, an actuator assembly for mounting within the thickness of a door which is hinged for movement between open and closed positions relative to the door frame, an operating member coupled by a linkage to the anchor assembly and mounted for a range of movements between a retracted position in which the anchor assembly is held adjacent to the actuator assembly and an extended position in which the anchor assembly is in spaced relation to the actuator assembly, a resilient driving apparatus arranged to exert a driving force on the operating member to drive the operating member towards the retracted position and thereby draw the anchor assembly and the actuator assembly together such that, when installed, the door closer acts to draw the door into its closed position relative to the frame, a damper mechanism operatively connected to the operating member so as to damp movement of the operating member at least in a direction towards the retracted position as the door is drawn closed by the driving apparatus, a resilient thrust device arranged to exert an increased driving force on the operating member over a defined part of its range of movement as the operating member approaches the retracted position, corresponding to movement of the door over a final part of its movement into its closed position, and wherein the resilient thrust device includes at least one spring which acts in a direction generally normally inwards relative the direction of movement of the operating member, to apply the increased driving force to the operating member.

Thus in contrast to previous proposals where an increased driving force on the operating member to close the door over the final part of its movement into the closed position has been exerted by springs which act in a direction generally parallel to the direction of movement of the operating member, in accordance with the present invention the at least one spring acts generally normally to this direction.

Preferably the point at which the resilient thrust device becomes operative to apply the increased driving force, depends upon the relative positions of a cam surface and a cam follower of the resilient thrust device.

Preferably the at least one spring includes a leaf spring which is fixed at or adjacent one end relative to a mounting of the actuator assembly, and the spring carries at or adjacent an opposite end, the cam follower which, when the thrust device is operative, follows and exerts a force on a cam which moves with the operating member.

In a preferred arrangement the cam is provided externally of a carrier which moves with the operating member, and when the thrust device is operative, the leaf spring exerts a force generally radially towards an axis along which the carrier moves as the door is closed by the driving apparatus.

The cam follower preferably includes a roller to facilitate its movement along the cam.

In one example, the carrier is provided by a sleeve secured relative to the operating member, the sleeve being received on and slidable along a rod which thus guides the carrier movement, the rod being fixed relative to the mounting of the actuator assembly. The position of the sleeve on the rod where the increased driving force becomes operative may be adjustable by varying the relative positions of the operating member and an anchor member of the anchor assembly. For example, the anchor assembly may include a mounting plate which is fixed relative to the door frame, and an anchor member to which the articulated link is fixed, the position of the anchor member relative to the mounting plate being adjustable. However adjustments may be effected alternatively as desired.

It will be appreciated that the shape of the cam is crucial to an increased driving force of an appropriate magnitude being exerted in an appropriate direction. Preferably the cam extends from a carrier part along which the cam follower may move during movement of the operating member otherwise than over the defined part of its range of movement as the operating member approaches the retracted position. The cam may include a simple inclined surface along which the cam follower rides, the resultant of the force applied by the spring acting transversely to the direction of movement of the carrier, and the reaction of the inclined surface, being in the direction of movement of the operating member to apply the increased force.

The damper mechanism may be a fluid operated damper mechanism including a cylinder containing fluid, a piston rod carrying a piston which divides the cylinder into two chambers, and a flow-restricting device to limit the rate of flow of fluid from one of the chambers to the other at least in one direction of fluid flow in response to movement of the operating member towards the retracted position. However an alternative damper mechanism may be provided if required.

Where the damper mechanism is fluid operated, the flow-restricting device may include an adjustable throttle which includes two elements in combination, fluid flow restriction imposed on the fluid by the throttle being variable by relative positional adjustment of the two throttle elements. An adjustment member may be provided to enable one of the throttle elements to be positionally adjusted relative to the other so as to vary the flow restriction imposed on the hydraulic fluid by the throttle.

In previous proposals described in prior patents identified above, one of the elements of the adjustable throttle has been a needle valve the position of which is adjustable relative to a valve seat which had provided the other of the elements.

To enable finer adjustments to be made to the fluid flow restriction than is readily possible with such an arrangement, preferably one of the elements of the adjustable throttle includes a fluid flow path which restricts fluid flow, the length of the fluid flow path, and hence the restriction to fluid flow being adjustable. For example the one element may include a groove, such as a spiral groove, which extends around and along an axis about which and along which the one element is moveable, by the adjustment member, the other of the two elements including a port with which a desired part of the groove is brought into registry to provide a required fluid flow restriction. To enable such movement of the one element of the throttle, the one element may include an external threaded formation which engages an internal threaded formation in a passage in which the flow restriction device may be incorporated, the passage communicating with the first and second chambers of the cylinder.

The adjustment member where provided, may be accessible by inserting a tool axially into an opening in an edge mounting of the actuator assembly at the door edge. The adjustment member may include a head formation, with which a tool may be engaged to permit the one element to be rotated and thus its position relative to the other element, to be adjusted. In a preferred embodiment, the door closer includes a pair of driving apparatus, and the resilient thrust device includes a pair of springs, which each act in a direction transverse to the direction of movement of the operating member, and preferably in mutually opposite directions e.g. towards one another, to apply the increased driving force to the operating member. Thus the pair of springs of the resilient trust device may each carry cam followers which may act on a common cam where the cam is provided externally on a carrier which moves with the operating member.

The arrangement of driving apparatus and resilient thrust device may thus be disposed symmetrically about an axis along which the operating member carrier moves when the door is opened and closed. However non-symmetrical arrangements are possible.

According to a second aspect of the invention, a door closer is provided including an anchor assembly for mounting on a door frame, an actuator assembly for mounting within the thickness of a door which is hinged for movement between open and closed positions relative to the door frame, an operating member coupled by a linkage to the anchor assembly and mounted for a range of movements between a retracted position in which the anchor assembly is held adjacent to the actuator assembly and an extended position in which the anchor assembly is in spaced relation to the actuator assembly, a resilient driving apparatus arranged to exert a driving force on the operating member to drive the operating member towards the retracted position and thereby draw the anchor assembly and the actuator assembly together such that, when installed, the door closer acts to draw the door into its closed position relative to the frame, a damper mechanism operatively connected to the operating member so as to damp movement of the operating member at least in a direction towards the retracted position as the door is drawn closed by the driving apparatus, the damper mechanism including a piston in a cylinder, the piston dividing the cylinder into two chambers, the piston and cylinder relatively moving as the door is opened and closed, so that fluid flows from one chamber to the other depending upon the direction of door movement, the damper mechanism further including an adjustable throttle to restrict fluid flow from one of the chambers to the other as the door is drawn closed by the resilient driving apparatus, the throttle including two elements in combination, fluid flow restriction imposed on the fluid by the throttle being variable by relative positional adjustment of the two throttle elements, one of the elements of the adjustable throttle including a fluid flow path which includes a groove, which extends around and along an axis about which and along which the one element is moveable, the other of the two elements including a port with which a desired part of the groove is brought into registry to provide a required fluid flow restriction.

The door closer of the second aspect of the invention may have any of the features of the door closer of the first aspect of the invention.

According to a third aspect of the invention, a door construction is provided, including a frame, a door mounted in the frame, and a door closer according to the first or second aspect of the invention.

BRIEF DESCRIPTION OF THE SEVERAL VIEWS OF THE DRAWINGS

Embodiments of the invention will now be described by way of example, with reference to the accompanying drawings.

DETAILED DESCRIPTION OF THE INVENTION

Figure 1:
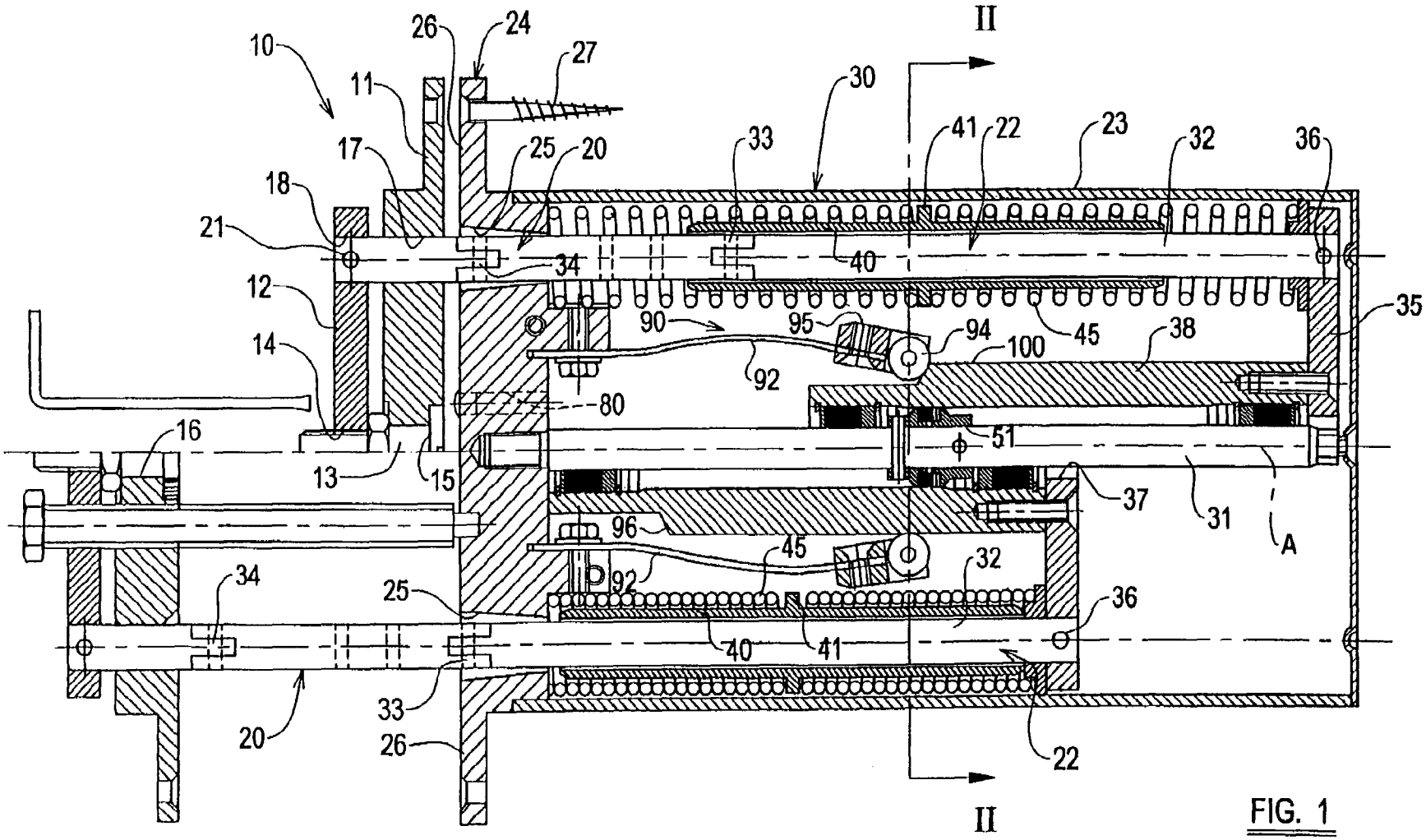
FIG. 1 is a sectional side view of one embodiment of a door closer in accordance with the present invention, showing the positions of the components of the door closer when the door is both closed (in the upper part of the figure) and in the open condition (in the lower part of the figure).
Figure 2:
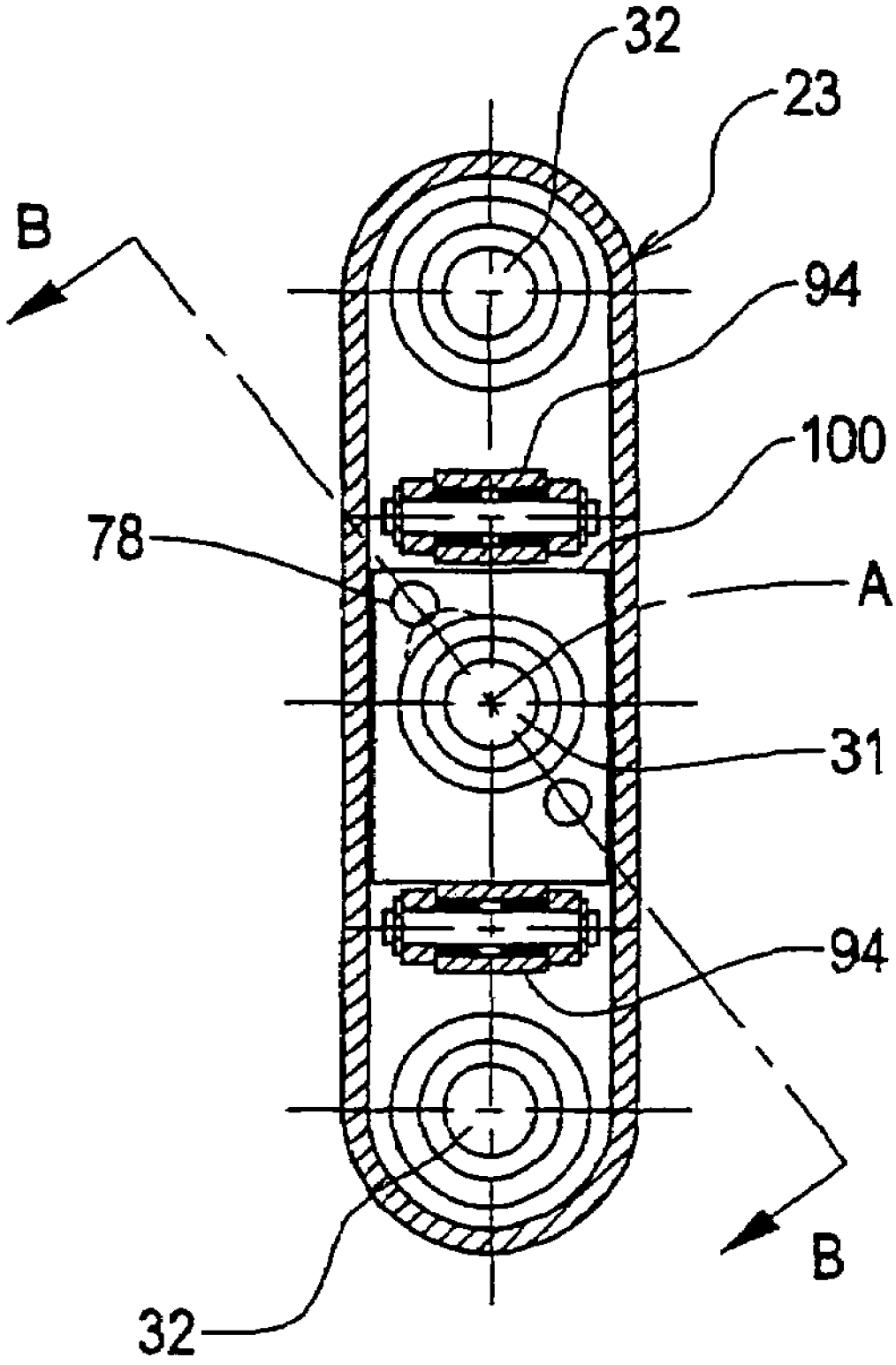
FIG. 2 is a sectional view of an actuator assembly of the door closer of FIG. 1 in the direction of arrow II-II of FIG. 1.

The door closer 1 as illustrated in the figures includes an anchor assembly 10 which is in use, mounted in or on a door frame at an edge thereof facing an edge of a door hinged to the frame, and an actuator assembly 30 which is mounted in use, within the thickness of the door.

The anchor assembly 10 includes a mounting plate 11 which is fixed relative to the frame, and an adjustable anchor member 12 which in this example is a plate which is spaced from the mounting plate 11 on the side thereof remote from the door, by an adjustable distance. An adjusting screw 13 is engaged in a threaded hole 14 formed in the anchor member 12, and a slotted head portion 15 of the screw 13 bears against the mounting plate 11 and is located in a central hole 16 formed in the mounting plate 11. It will be understood that by rotation of the screw 13 the spacing of the anchor member 12 and mounting plate 11 can be varied for the purpose hereinafter described.

The mounting plate 11 is also formed with a pair of apertures 17 near the ends thereof and the anchor member 12 is formed with a pair of apertures 18 aligned with the apertures 17. The anchor member 12 is coupled to the one ends of a pair of linkages which are in this example, each provided by articulated links 20, by transverse pins 21 which are accommodated within the thickness of the anchor member 12, and the other ends of the links 20 are each coupled to a cross member 35 of an operating member 22 of the actuator assembly 30 for a purpose hereinafter described.

The actuator assembly 30 is so dimensioned as to be suitable for fitting within the thickness of the door and for this purpose is provided with housing 23 which includes an edge mounting member 24 which in use is located at the edge of the door, the edge mounting member 24 having apertures 25 which align with the apertures 17 of the anchor assembly mounting plate 11, and outwardly extending flange parts 26 which have apertures to receive fixing screws 27 for fixing the actuator assembly 30.

Within the housing 23 of the actuator assembly 30, there is provided a rod 31 which has a threaded end portion received in a threaded bore of the edge mounting member 24, a central axis A of the rod 31 coinciding in this example, with an axis of symmetry of the actuator assembly 30.

The operating member 22 includes a pair of parallel shafts 32 which each extend generally parallel to the rod 31, the parallel shafts 32, each being coupled to a respective articulated link 20 at a pivotal connection 33, the links 20 each including a pair of sections pivotally connected at 34, so that articulation is permitted between the link 20 sections, and the links 20 and the shafts 32 as the door is opened and closed.

The operating member 22 further includes, at the other ends of the shafts 32, the cross member 35 to which each of the shafts 32 is connected by a transverse pin 36 which is received within the thickness of the cross member 35. The cross member 35 also carries a sleeve 38 which receives within it, as hereinafter described, the rod 31, and the cross member 35 further includes an aperture 37 though which the rod 31 extends, as the operating member 22 and hence the sleeve 38 carried thereby, moves in the housing 23 in the direction of the axis A, as the door is opened and closed.

The operating member 22 is biased inwardly of the housing 23 towards a retracted or "door closed" position shown in the upper part of FIG. 1, under the force of a resilient driving apparatus provided by a pair of driving springs 45. The springs 45 extend between the cross member 35 and the edge mounting member 24 and are each received on a floating sleeve 40 received on a shaft 32 of the operating member 22. In the example shown the sleeve 40 also receives a part of the articulated link 20, at least when the link 20 is fully retracted into the housing 23 as seen in the upper part of FIG. 1. In the illustrated embodiment, the driving springs 45 are each provided by a pair of coil springs which may be oppositely wound and separated by a flange 41 of the respective floating sleeve 40, so that as the resilient force applied to the operating member 22 to retract the articulated links 20, is normalized over the entire range of movement of the operating member 22.

As will be evident, the driving springs 45 when compressed, act on the cross member 35 to drive the latter inwardly of the actuator assembly 30 (i.e. to the right as seen in FIG. 1) to the retracted position and to draw the shafts 32 and the associated links 20 inwardly of the housing 23 so as to bring the mounting plate 11 of the anchor assembly 10 up to the edge mounting member 24 of the actuator assembly 30, thereby urging the door to its closed position.

When the door is opened, as shown in the lower part of FIG. 1, the shafts 32 and cross member 35 of the operating member 22 are drawn outwardly (i.e. to the left), thereby causing the driving springs 45 to be compressed further. When the door is released from its "door open" position, the driving springs 45 act to return the cross member 35 and the shafts 32 to their starting positions, thereby bringing the door back to its closed position relative to the frame.

The actuator assembly 30 further includes a damper mechanism 50 to regulate the rate of closure of the door under the action of the driving springs 45.

Figure 3:
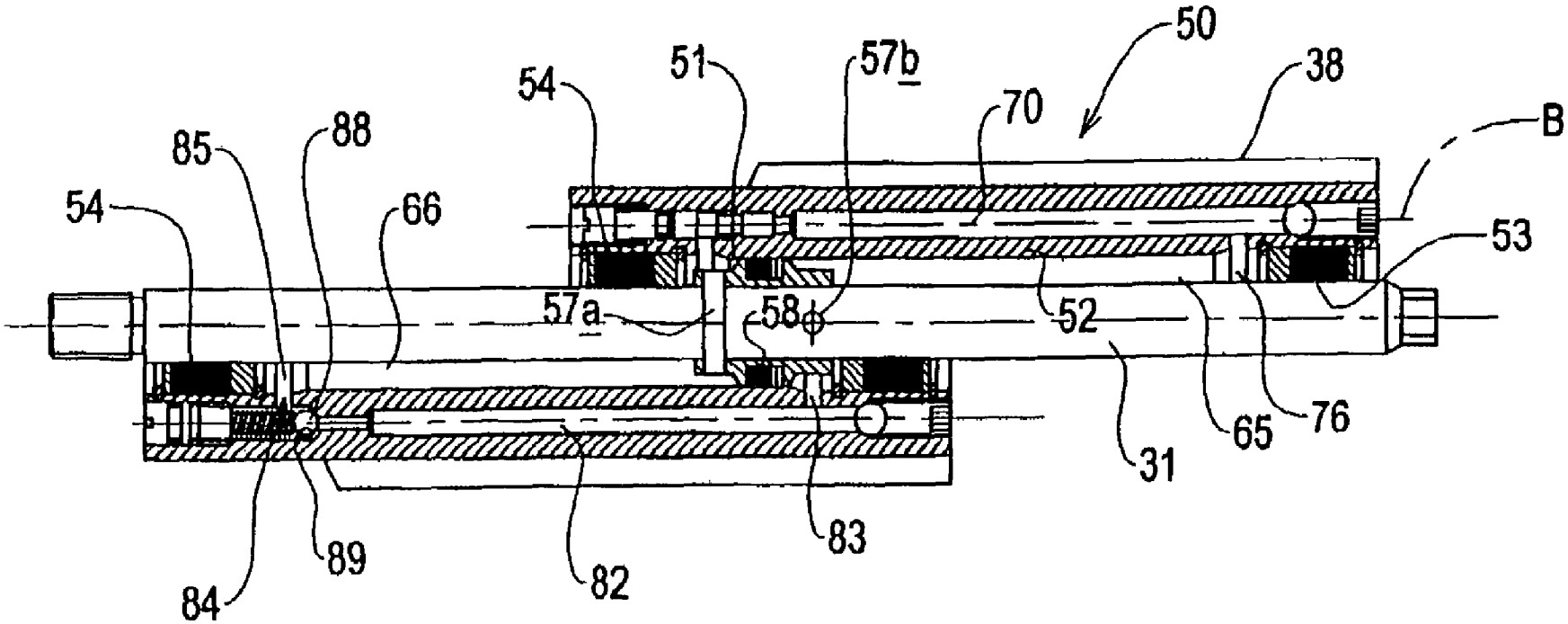
FIG. 3 is a horizontal sectional view across line B-B of FIG. 2 of part of the door closer, showing added detail not seen in FIG. 1.

The damper mechanism 50 as seen best in FIG. 3 includes a fixed piston 51 formed on the rod 31 at a position intermediate its ends, and a cylinder 52 provided by the sleeve 38 carried by the operating member 22. The cylinder 52 contains a fluid, preferably hydraulic fluid.

The cylinder 52 has at the end closest the cross member 35, a seal 53 which is moveable along the rod 31 with the cylinder 52 and contains the fluid in an inner chamber 65 of the cylinder 52 between the seal 53 and the piston 51. At the other end of the cylinder 52, there is a further seal 54 which is moveable along the rod 31 with the cylinder 52 and contains the fluid in an outer chamber 66 of the cylinder 52 between the seal 54 and the piston 51.

The piston 51 is annular and includes a piston head 57 and a seal 58 which provides a seal between the piston 51, and each of the cylinder 52 and the rod 31, as the cylinder 52 moves along the rod 31. The piston 51 is fixed to the rod 31 by a pair of pins 57*a*, 57*b*. Thus the piston 51 divides the cylinder 52 into inner and outer chambers 65, 66. The piston 51 includes a backing ring R further to support the seal 58.

Figure 4:
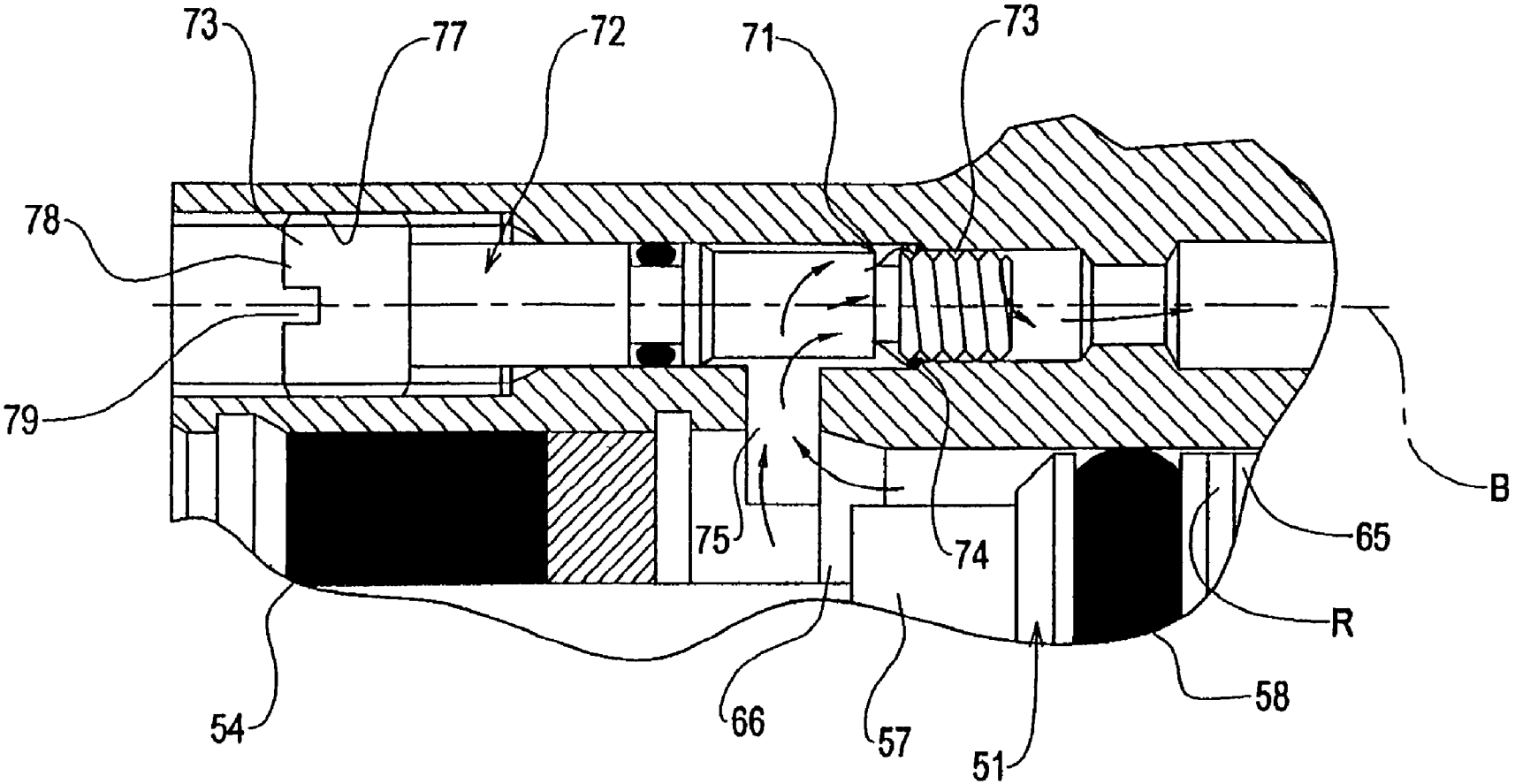
FIG. 4 is an enlarged partial sectional view the part of the door closer seen in FIG. 3 showing yet more detail.

A first fluid passage 70 generally parallel to the rod 27 is provided in a wall of the cylinder 52 to enable fluid to pass from the outer chamber 66 to the inner chamber 65 in a controlled manner, as the door is moved to the closed position by the resilient driving apparatus provided by the springs 45. This is shown in the upper part of FIG. 3. The first fluid passage 70 includes an adjustable throttle 71 (see FIG. 4) which restricts fluid flow along the first fluid passage 70, the length of the fluid flow path through the throttle 71, and hence the restriction to fluid flow, being adjustable.

In this example the throttle 71 is provided by a throttle element 72 which includes a groove, such as a spiral groove 73 (see FIG. 4 where this detail is best seen), which groove 73 extends around and along an axis B of the first fluid passage 70 about which and along which the throttle element 72 is moveable by an adjustment member 73. The throttle element 72 is moveable relative to a port 74 to which fluid from the outer chamber 66 may flow through a transverse connecting passageway 75, with which port 74 a desired part of the groove 73 may be brought into registry, to vary the length of the groove 73 along which the fluid is constrained to flow from the port 74 to the other side of the throttle element 72 and hence to the inner chamber 65 of the cylinder 52 via a further transverse connecting passageway 76, to provide a required fluid flow restriction and thus controlled fluid flow.

To enable the position of the throttle element 72 to be adjusted, the throttle element 72 includes an external threaded formation which engages a corresponding internal threaded formation 77 in the first fluid flow passage 70. The adjustment member 73 has an integral head formation 78 which includes a slot 79 or other formation with which a tool, such as a screwdriver may be inserted by inserting the tool through an opening 80 (see FIG. 1) in edge the mounting member 24.

A second fluid passage 82 generally parallel to the rod 31 is provided in the wall of the cylinder 52 too, to enable fluid to pass from the inner chamber 65 to the outer chamber 66, as the door is moved to the open position, with such fluid flow being substantially unimpeded.

As can be seen in the lower part of FIG. 3, the second fluid flow passage 82 communicates with each of the inner and outer chambers 65, 66 via respective transverse connecting passage 83, 85, but within the second fluid flow passage 82 there is provided a one way valve 84. In this example this includes a sprung ball valve member 88 which is urged towards a seat 89, such that the valve member 88 prevents fluid flow from the outer to the inner passage 66, 65 as the door is closed, but is lifted off its seat 89 in response to fluid pressure as fluid flows from the inner to the outer chamber 65, 66 as the door is opened.

Thus fluid may flow freely from the inner chamber 65 to the outer chamber 66 via the second fluid flow passage 82 and the door may be opened freely. However, in response to movement of the door towards its closed position, fluid flow from the outer to the inner chamber 66, 65 through the first fluid flow passage 70 is permitted in a controlled manner via the throttle 71. Any fluid flow from the inner to the outer chamber 65, 66 via the throttle 71 during door opening is inconsequential. 46 The door closer 1 further includes a resilient thrust device 90 to exert an increased driving force on the operating member 22 over a defined part of its range of movement as the operating member 22 approaches the retracted position, corresponding to movement of the door over a final part of its movement into its closed position.

The thrust device 90 includes a pair of springs, in this example leaf springs 92, which each act in a direction generally normal to the direction of movement of the operating member 22 which moves along axis A. Other spring arrangements which act in this direction could alternatively be provided. The leaf springs 92 are each fixed at or at least close to their one ends relative to the edge mounting member 24 of the actuator assembly 30, and each carry at or adjacent their opposite ends, a cam follower provided by a roller 94 which is secured relative to the leaf spring 92, by a fastener 95.

The leaf springs 92 are mounted to either side of the rod 31, and are configured to exert a resilient force generally radially inwardly of the rod 31.

A cam 96 is provided which the cam followers 94 follow during the final part of the door's movement towards its closed position. In this example, conveniently the cam 96 is carried by a cam carrier provided by the sliding sleeve 38 which also provides the cylinder 52 of the damper assembly 50, on an external surface of the sleeve 38.

The shape of the cam 96 will determine a resultant force arising by the generally radially inward force exerted by the leaf springs 92 acting on the cam 96, the cam 96 shape being such that the resultant force acts in a direction generally along the axis of the rod 31 to increase the driving force provided by the driving apparatus provided by the driving springs 45. In its simplest form, the cam 96 may be a surface which is inclined at about 45° to the axis A of the rod 31, but desirably the cam 96 is of a more complex shape designed to enable the maximum increased thrust initially to be applied as the followers 94 follow an initial part of the cam 96 which initial part of the cam 96 may correspond to a door position where a door latch of a spring latching mechanism first engages its keeper as the door closes, and at which position a spring force of the latching mechanism needs to be overcome.

The position of the sleeve 38 on the rod 31, where the increased driving force becomes operative, i.e. the point at which the resilient thrust device becomes operative to apply the increased driving force to increase the force exerted on the operating member 22 to close the door, over a defined range of the closing movement, may be adjustable by varying the relative positions of the operating member 22 and the anchor member 12 of the anchor assembly 10. This is achieved as previously described by adjusting the position of the anchor member 12 relative to the mounting plate 11 by turning the adjusting screw 13, so as to adjust the position of the operating member 22 relative to the anchor member 12.

Thus, the effect of the thrust device 90 is to provide an additional closing force during the final stage of a door closing operation, thus overcoming any resistance to door closure which may, for example, be imposed by a latching mechanism which operates between the door and the door frame. The thrust device 90 also maintains an urging force on the operating member 22 to assist in maintaining the door closed.

Thus, the adjustable anchor member 12 enables the point at which the thrust device come into operation to be varied. Adjustment of the anchor member 12 relative to the mounting plate 11 of the anchor assembly 10 alters the angular position of the door at which the cam follower 94 engages the cam 96.

During door closing, prior to the point at which the cam followers 94 engage the cam 96, the cam followers 94 may ride on a carrier part surface 100 without exerting any increased driving force to the force exerted by the driving apparatus, i.e. the driving springs 45.

Typically, the range of door closing at which the increased driving force is applied, is between 00 and about 7° of opening but may be up to 15° of opening. Thus at one extreme, the thrust device 90 may be rendered ineffective as the cam followers 94 ride on the carrier part surface 100, whilst the range of angular movement over which the thrust device 90 is effective, can be set, e.g. at up to 70 or thereabouts according to the precise geometry adopted.

Adjustment of the damper mechanism 50 by adjusting the throttle 71, makes it possible to provide controlled closing even when the increased force is exerted by the thrust device 90. When the flow restriction is set to a minimum, or a "soft" action, where a minimal restriction to fluid flow from the outer chamber 66 to the inner chamber 65 is provided, i.e. the throttle element 72 is outwardly positioned to provide a short restricted flow path along the groove 73, the increased driving force exerted by the thrust device 90 may be applied over a short duration, whereas when the flow restriction is set to a maximum, where a maximum restriction to fluid flow from the outer chamber 66 to the inner chamber 65 is provided, i.e. the throttle element 72 is inwardly positioned to provide a long restricted flow path along the groove 73, the increased force exerted by the thrust device 90 may be applied over a longer duration.

Thus the door closer 1 as described is fully adjustable with respect to the selected range of angular movement over which the increased closure force is applied, and with respect to the degree of damping applied, whilst being particularly compact so that it can be installed in a door without compromising the fire resistance of the door.

Many modifications may be made without departing from the scope of the invention. For example, in the embodiments described, the operating member 22 has been provided by a pair of shafts 42 arranged symmetrically about an axis A, but in another example, only a single shaft and consequently a single driving spring 45 (which may include one or more than one coil spring) and articulated link 20, may be provided.

If desired, any mutually engaging services of the various components could be coated with a material having a low co-efficient of friction (such as PTFE) to reduce wear problems as far as possible and to maximize the increased force applied by the thrust drive.

I claim:

1. A door closer apparatus for mounting on a door frame so as to move the door between an open position and a closed position, the apparatus comprising:

an anchoring means for mounting on the door frame, an actuating means for mounting within the thickness of the door in which the door is hinged for movement between the open and closed positions relative to the door frame, an operating member coupled by a linkage to the anchoring means and mounted for a range of movements between a retracted position in which the anchoring means is held adjacent to the actuating means and an extended position in which the anchoring means is in spaced relation to the actuating means;

a resilient driving means arranged for exerting a driving force on the operating member to drive the operating member towards the retracted position and thereby draw the anchoring means and the actuating means together such that the door is drawn into its closed position relative to the frame;

a damping means operatively connected to the operating member for damping movement of the operating member at least in a direction towards the retracted position as the door is drawn closed by the driving means;

a resilient thrusting means arranged for exerting an increased driving force on the operating member over a defined part of its range of movement as the operating member approaches the retracted position so as to correspond to movement of the door over a final portion of the movement into the closed position, said resilient thrusting means comprising:

at least one spring which acts in a direction generally normally inwardly relative to the direction of the movement of the operating member so as to apply the increased driving force to the operating member, said resilient thrusting means having a cam and a cam follower, said resilient thrusting means for initiating the increased driving force on the operating member based on a relative position of said cam and said cam follower, said at least one spring being a leaf spring having one end affixed to or adjacent said actuating means, said spring carrying said cam follower at or adjacent to an opposite end thereof, said leaf spring following and exerting a force on said cam as said cam moves with said operating member.

2. The closer apparatus of claim 1, wherein said cam is exterior of a carrier which moves with said operating member, said leaf spring exerting a force generally radially towards an axis along which the carrier moves as the door is closed by said driving means.

3. The closer apparatus of claim 2, said carrier having a sleeve secured relative to the operating member, said sleeve being received on and slidable along a rod, said rod guiding said carrier, said rod being fixed relative to said actuating means, a position of said sleeve on the rod being adjustable by varying the relative positions of the operating member and an anchor member of said anchoring means.

4. The closer apparatus of claim 3, said anchoring means comprising:

a mounting plate which is fixed relative to the door frame; and an anchor member adjustably positioned relative to the mounting plate.

5. The closer apparatus of claim 1, wherein the cam follower has a roller in rolling contact along said cam.

6. The closer apparatus of claim 1, wherein said cam extends from a carrier part along which the cam follower moves during movement of the operating member.

7. The closer apparatus of claim 1, wherein the cam has an inclined surface along which the cam follower rides.

8. The closer apparatus of claim 1, wherein the said damping means is a fluid-operated damper comprising:

a cylinder containing a fluid;

a piston rod carrying a piston which divides said cylinder into a pair of chambers; and a flow-restricting means for limiting a rate of flow of fluid from one of said pair of chambers to the other of said pair of chambers at least in one direction of fluid flow in response to movement of the operating member towards the retracted position.

9. The closer apparatus of claim 8, wherein said flow-restricting means has an adjustable throttle which includes a pair of elements, a fluid flow restriction imposed on the fluid by said throttle being variable by relative positional adjustment of said pair of elements, and an adjusting means for enabling one of said pair of elements to be positionally adjusted relative to the other so as to vary the flow restriction imposed on the fluid by said throttle.

10. The closer apparatus of claim 9, wherein one of the pair of elements of said adjustable throttle has a fluid flow path which restricts fluid flow, the length of the fluid flow path being adjustable, one of the pair of elements having a groove which extends around and along an axis about which and along which the one of pair of elements is moveable, the other of the pair of elements including a port with which a portion part of said groove is brought into registry so as to provide a required fluid flow restriction.

11. The closer apparatus of claim 9, wherein one of said pair of elements has an external threaded formation which engages an internal threaded formation in a passage in which the flow-restricting means is incorporated, said passage communicating with said pair of chambers of said cylinder.

12. The closer apparatus of claim 9, wherein said adjusting means being accessible through an opening in an edge mounting of the actuating means, the adjusting means having a head formation suitable for engagement by a tool to permit said one of said pair of elements to be rotated and relative to the other of said pair of elements.

13. The closer apparatus of claim 1, wherein said resilient thrusting means has a pair of springs, each of said pair of springs acting in a direction transverse to the direction of movement of said operating member, said pair of springs acting in mutually opposite directions so as to apply an increased driving force to the operating member.

* * * * *